US012628950B2

(12) United States Patent
Chen et al.

(10) Patent No.: US 12,628,950 B2
(45) Date of Patent: May 19, 2026

(54) SLIDE RAIL ASSEMBLY

(71) Applicants: KING SLIDE WORKS CO., LTD., Kaohsiung City (TW); KING SLIDE TECHNOLOGY CO., LTD., Kaohsiung City (TW)

(72) Inventors: Ken-Ching Chen, Kaohsiung City (TW); Fang-Cheng Su, Kaohsiung City (TW); Yue-Hua Tang, Kaohsiung City (TW); Chun-Chiang Wang, Kaohsiung City (TW)

(73) Assignees: KING SLIDE WORKS CO., LTD., Kaohsiung City (TW); KING SLIDE TECHNOLOGY CO., LTD., Kaohsiung City (TW)

( * ) Notice: Subject to any disclaimer, the term of this patent is extended or adjusted under 35 U.S.C. 154(b) by 198 days.

(21) Appl. No.: 18/653,945

(22) Filed: May 2, 2024

(65) Prior Publication Data

US 2025/0089892 A1 Mar. 20, 2025

(30) Foreign Application Priority Data

Sep. 15, 2023 (TW) ..... 112135589

(51) Int. Cl.
*A47B 88/443* (2017.01)
*A47B 88/49* (2017.01)

(52) U.S. Cl.
CPC ..... *A47B 88/443* (2017.01); *A47B 88/49* (2017.01)

(58) Field of Classification Search
CPC ..... A47B 88/49; A47B 88/443; A47B 88/447; A47B 88/493; A47B 2210/004
USPC .... 312/334.1, 334.8, 334.13, 334.14, 334.15
See application file for complete search history.

(56) References Cited

U.S. PATENT DOCUMENTS

| | | | | |
|---|---|---|---|---|
| 9,498,061 | B2 | 11/2016 | Liang | |
| 9,526,334 | B2 | 12/2016 | Liang | |
| 10,470,570 | B2 * | 11/2019 | Chen | A47B 88/407 |
| 11,013,320 | B2 | 5/2021 | Meusburger | |
| 11,272,784 | B2 | 3/2022 | Meusburger | |
| 2012/0049712 | A1 * | 3/2012 | Lobbezoo | A47B 88/493 384/51 |
| 2013/0002115 | A1 * | 1/2013 | Friesenecker | A47B 88/447 312/334.8 |
| 2014/0241651 | A1 * | 8/2014 | Greussing | A47B 88/493 384/19 |

FOREIGN PATENT DOCUMENTS

| | | | |
|---|---|---|---|
| AT | 500 157 | A2 | 11/2005 |
| EP | 3 058 847 | A1 | 8/2016 |
| JP | 2018-61827 | A | 4/2018 |
| JP | 2020-58775 | A | 4/2020 |
| JP | 2020-530799 | A | 10/2020 |

* cited by examiner

*Primary Examiner* — James O Hansen
(74) *Attorney, Agent, or Firm* — Winston Hsu

(57) ABSTRACT

A slide rail assembly includes a first rail, a second rail, an aid-sliding device, a compensating device and a third rail. The aid-sliding device is movably mounted between the first rail and the second rail. The compensating device is movably mounted on the second rail. The second rail is configured to be movably mounted on the third rail. The compensating device is configured to compensate an error of a relative position of the first rail and the second rail.

14 Claims, 15 Drawing Sheets

SLIDE RAIL ASSEMBLY

BACKGROUND OF THE INVENTION

1. Field of the Invention

The present invention relates to a slide rail product, and more specifically, to a slide rail assembly for compensating an error of a relative position of at least two slide rails by utilizing a compensating device.

2. Description of the Prior Art

In U.S. Pat. No. 11,272,784 B2, it discloses a drawer pull-out guide including at least two guide rails displaceable relative to each other and a sliding having carriage load-transmitting rolling members. The sliding carriage is movably supported between the at least two guide rails. A relative position of the at least two guide rails is preset to a predetermined relative position upon a movement of the sliding carriage. The drawer pull-out guide further includes a compensating device for compensating an error of the relative position of the at least two guide rails, i.e., a deviation from the predetermined relative position. The compensating device has an actuating device and a switching device. The actuating device is configured to be actuated by one of the at least two guide rails for compensating the error of the relative position of the at least two guide rails. The switching device is configured to disengage the compensating device from the one of the at least two guide rails when the at least two guide rails is in the predetermined relative position.

However, in order to meet various requirements, it becomes an important topic to provide an alternative solution for compensating an error of a relative position of at least two slide rails.

SUMMARY OF THE INVENTION

It is an objective of the present invention to provide a slide rail assembly for compensating an error of a relative position of at least two slide rails by utilizing a compensating device.

According to an aspect of the present invention, a slide rail assembly includes a first rail, a second rail, a first aid-sliding device, a first feature, a compensating device and a third rail. The first aid-sliding device includes at least one first rotating member configured to be rotatably supported between the first rail and the second rail. The first feature is arranged on the first rail. The compensating device is mounted on the second rail and movable between a first state and a second state. The second rail is movably mounted on the third rail. The third rail includes a supporting section and a blocking portion, and the supporting section is configured to support the compensating device. After the second rail is displaced to a lagging position relative to the first rail, the first rail displacing along an opening direction drives the first feature and the compensating device in the first state to abut against each other to drive the second rail to synchronously displace together with the first rail along the opening direction for a first predetermined distance until the compensating device is driven to move from the first state to the second state. After the second rail is displaced to an advancing position relative to the first rail, the first rail displacing along the opening direction drives the blocking portion of the third rail and the compensating device in the first state to block each other to stop the second rail until the first rail is displaced along the opening direction over a second predetermined distance to drive the first feature and the compensating device in the first state to abut against each other to drive the compensating device to move from the first state to the second state. When the compensating device is in the second state, the blocking portion of the third rail does not block the compensating device.

According to another aspect of the present invention, a slide rail assembly includes a first rail, a second rail, a third rail, a first feature and a compensating device. The second rail is movably mounted between the third rail and the first rail. The third rail includes a supporting section and a blocking portion, and the supporting section is configured to support the second rail. The first feature is arranged on the first rail. The compensating device is arranged on the second rail and movable between a first state and a second state. After the second rail is displaced to an advancing position deviated from a predetermined position relative to the first rail, the first rail displacing along the first direction drives the blocking portion of the third rail and the compensating device in the first state to block each other to stop the second rail until the first feature and the compensating device in the first state abut against each other to drive the compensating device to move from the first state to the second state. When the compensating device is in the second state, the blocking portion of the third rail does not block the compensating device.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top", "bottom", "left", "right", "front", "back", etc., is used with reference to the orientation of the Figure(s) being described. The members of the present invention can be positioned in a number of different orientations. As such, the directional terminology is used for purposes of illustration and is in no way limiting. Accordingly, the drawings and descriptions will be regarded as illustrative in nature and not as restrictive. Also, if not specified, the term "connect" is intended to mean either an indirect or direct mechanical connection. Thus, if a first device is connected to a second device, that connection may be through a direct mechanical connection, or through an indirect mechanical connection via other devices and connections.

Figure 1:
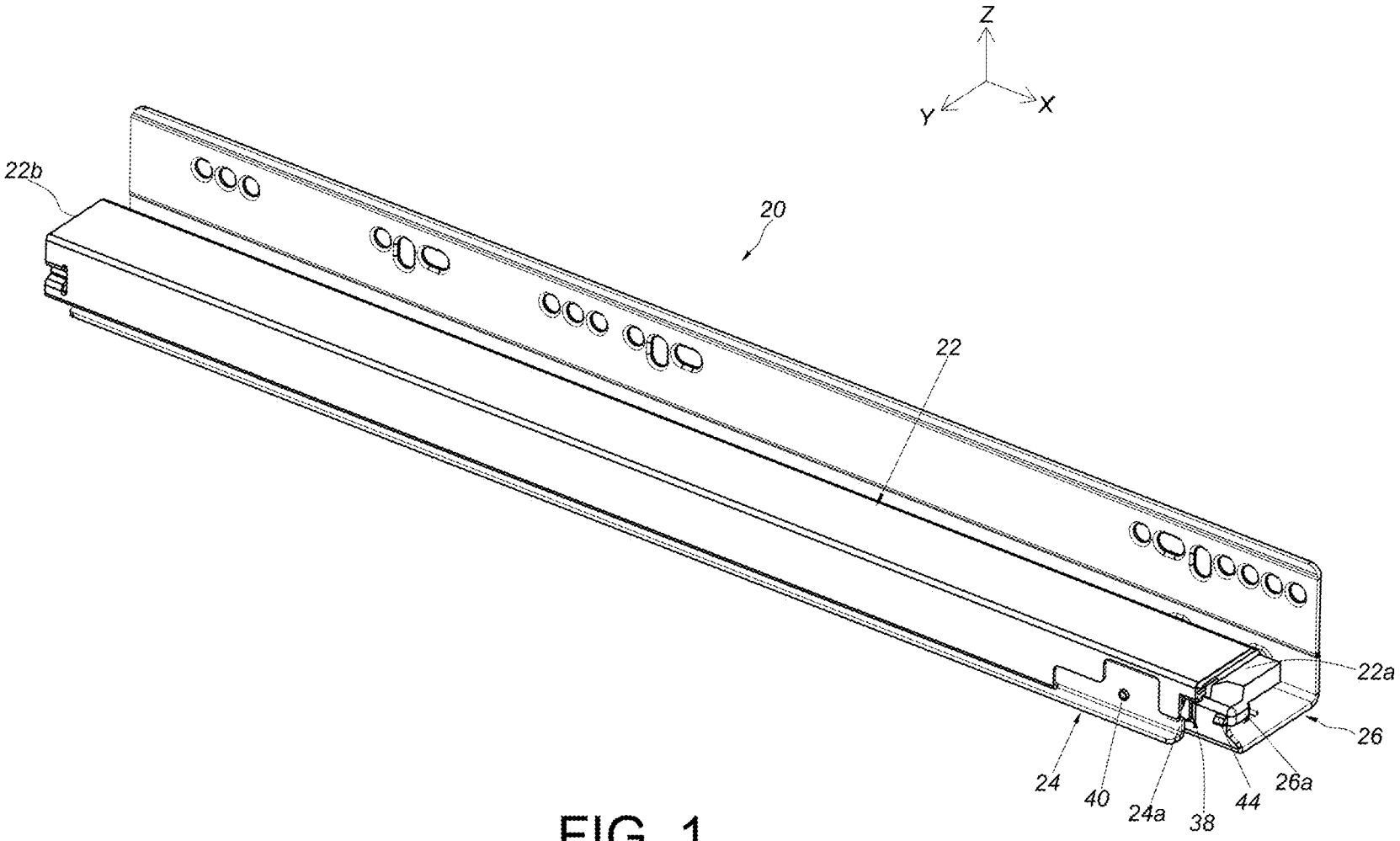
FIG. 1 is a schematic diagram of a slide rail assembly according to an embodiment of the present invention.
Figure 2:
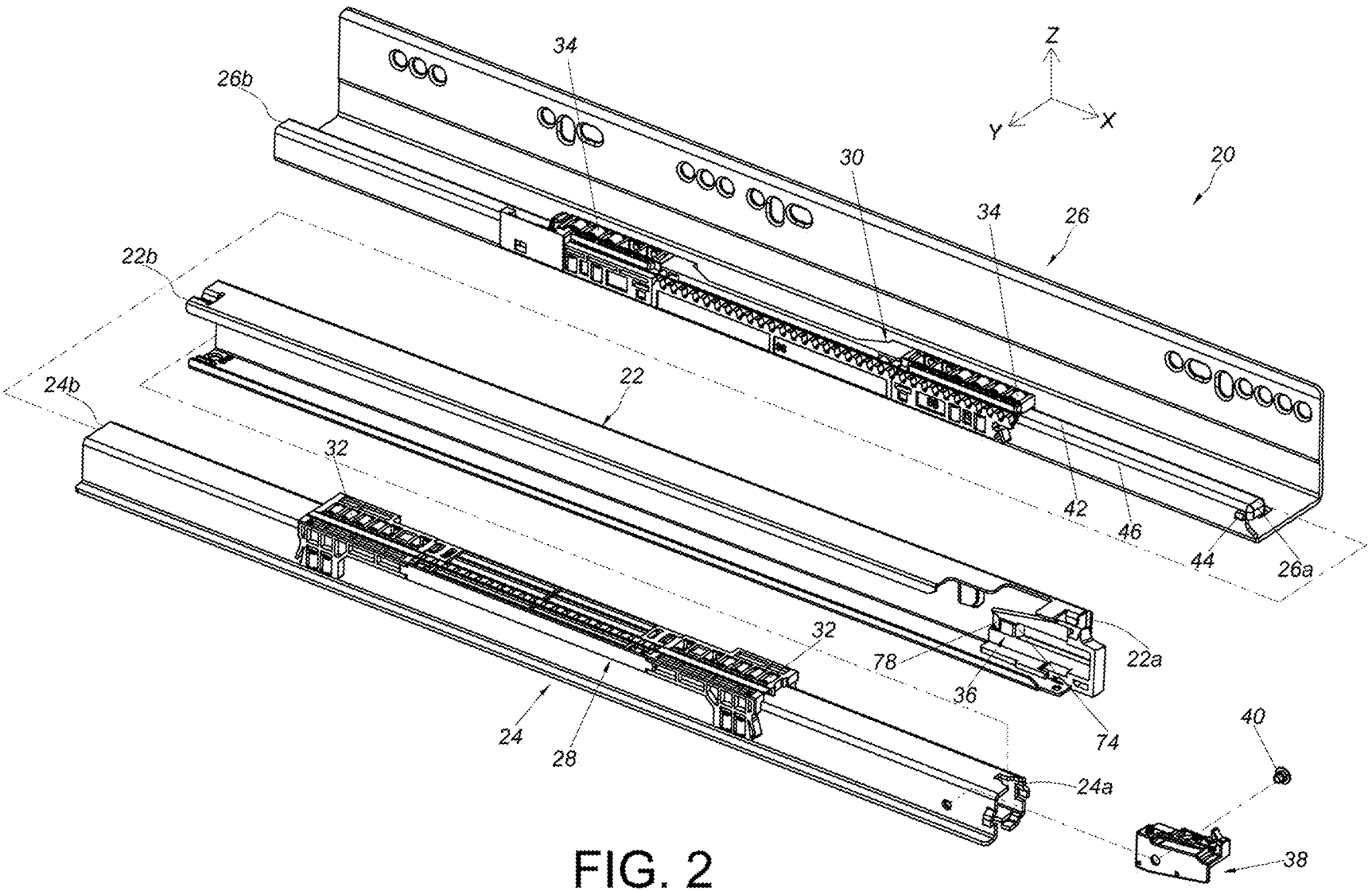
FIG. 2 is an exploded diagram of the slide rail assembly according to the embodiment of the present invention.

As shown in FIG. 1 and FIG. 2, a slide rail assembly 20 includes a first rail 22, a second rail 24, a third rail 26 and a first aid-sliding device 28. Preferably, the slide rail assembly 20 further includes a second aid-sliding device 30. The second rail 24 is movably mounted between the third rail 26 and the first rail 22, and the first rail 22 and the second rail 24 are displaceable relative to each other, and/or relative to the third rail 26 along a longitudinal direction. In this embodiment, by way of example, the longitudinal direction can be defined by a length direction of a slide rail, e.g., the first rail 22, the second rail 24 or the third rail 26, and parallel to an X axis. A transverse direction can be defined by a lateral direction or a width direction of the slide rail and parallel to a Y axis. A vertical direction can be defined by a height direction of the slide rail and parallel to a Z axis.

Furthermore, the second rail 24 is configured to be movably mounted on the third rail 26, and the first rail 22 is configured to be movably mounted on the second rail 24. The first aid-sliding device 28 is movably mounted between the first rail 22 and the second rail 24 for facilitating a relative displacement of the first rail 22 and the second rail 24. For example, the first aid-sliding device 28 includes at least one first rotating member 32 configured to be rotatably supported between the first rail 22 and the second rail 24, and the first rotating member 32 can be a roller or a ball. The second aid-sliding device 30 is movably mounted between the second rail 24 and the third rail 26 for facilitating a relative displacement of the second rail 24 and the third rail 26. For example, the second aid-sliding device 30 includes at least one second rotating member 34 configured to be rotatably supported between the second rail 24 and the third rail 26, and the second rotating member 34 can be a roller or a ball.

The slide rail assembly 20 further includes a first feature 36 and a compensating device 38.

The first feature 36 and the compensating device 38 are arranged on one and the other one of the first rail 22 and the second rail 24, respectively. In this embodiment, by way of example, the first feature 36 is arranged on the first rail 22, and the compensating device 38 is movably mounted on the second rail 24. Specifically, the first feature 36 can be arranged on the first rail 22 directly or indirectly, and the compensating device 38 can be pivotally connected to the second rail 24 by a shaft member 40. Preferably, the first rail 22 has a first end portion 22*a* and a second end portion 22*b* located opposite to the first end portion 22*a*, and the second rail 24 has a first end portion 24*a* and a second end portion 24*b* located opposite to the first end portion 24*a*. For example, the first end portion 22*a* and the second end portion 22*b* of the first rail 22 are a front end portion and a rear end portion of the first rail 22, respectively, and the first end portion 24*a* and the second end portion 24*b* of the second rail 24 are a front end portion and a rear end portion of the second rail 24, respectively. Preferably, the first feature 36 is a protruding structure located adjacent to the first end portion 22*a* of the first rail 22, and the compensating device 38 is located arranged adjacent to the first end portion 24*a* of the second rail 24. However, the present invention is not limited to this embodiment.

Figure 3:
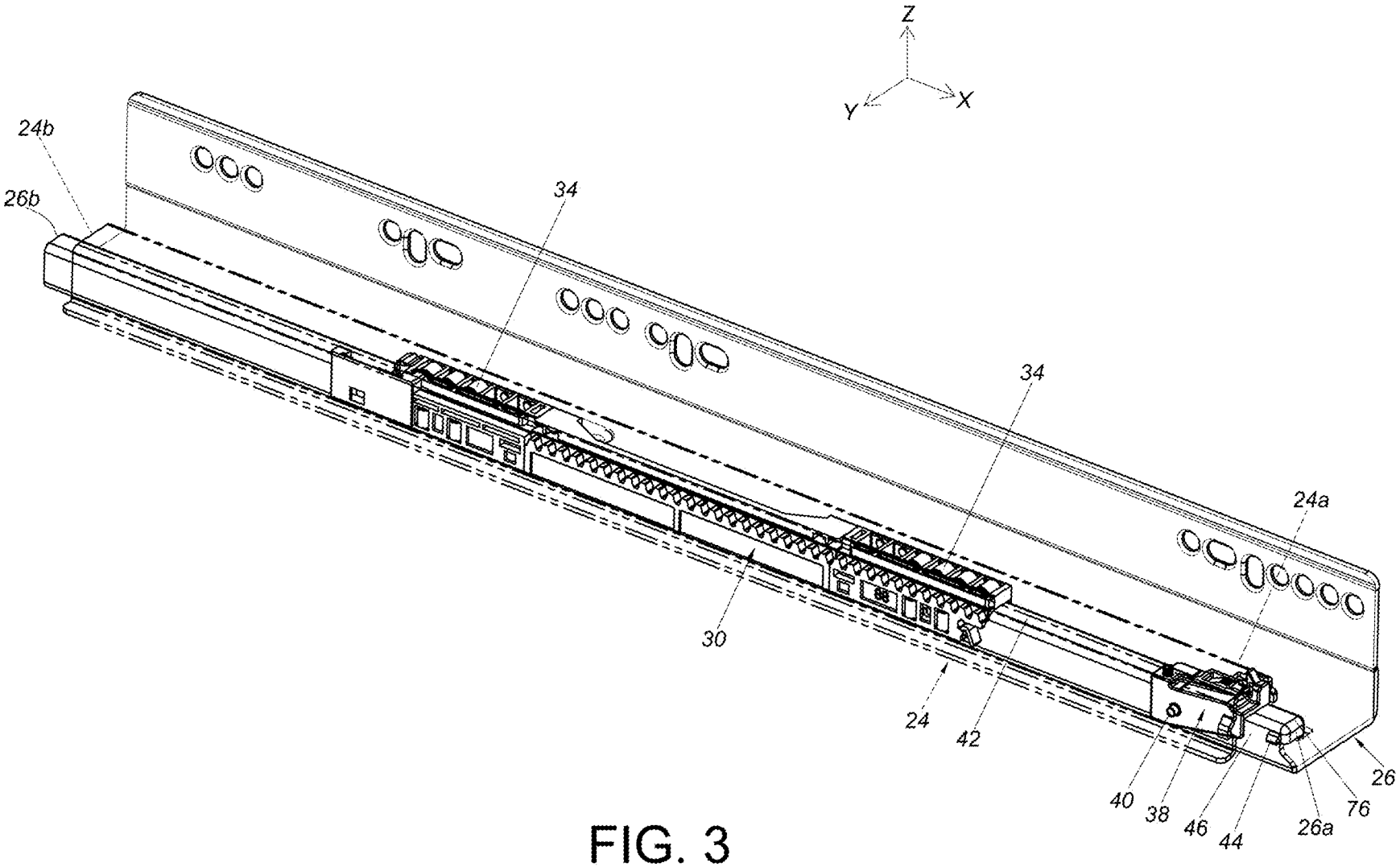
FIG. 3 is a partial diagram of the slide rail assembly according to the embodiment of the present invention.

As shown in FIG. 3, the third rail 26 has a first end portion 26*a* and a second end portion 26*b* located opposite to the first end portion 26*a*. For example, the first end portion 26*a* and the second end portion 26*b* of the third rail 26 are a front end portion and a rear end portion of the third rail 26, respectively. The third rail 26 includes a supporting section 42 and a blocking portion 44. The supporting section 42 extends between the first end portion 26*a* and the second end portion 26*b* of the third rail 26 along the longitudinal direction and configured to support the second rail 24 and/or the compensating device 38. In this embodiment, by way of example, the blocking portion 44 is a protrusion arranged on a lateral side 46 of the supporting section 42 and located adjacent to the first end portion 26*a* of the third rail 26. However, the present invention is not limited to this embodiment.

Figure 4:
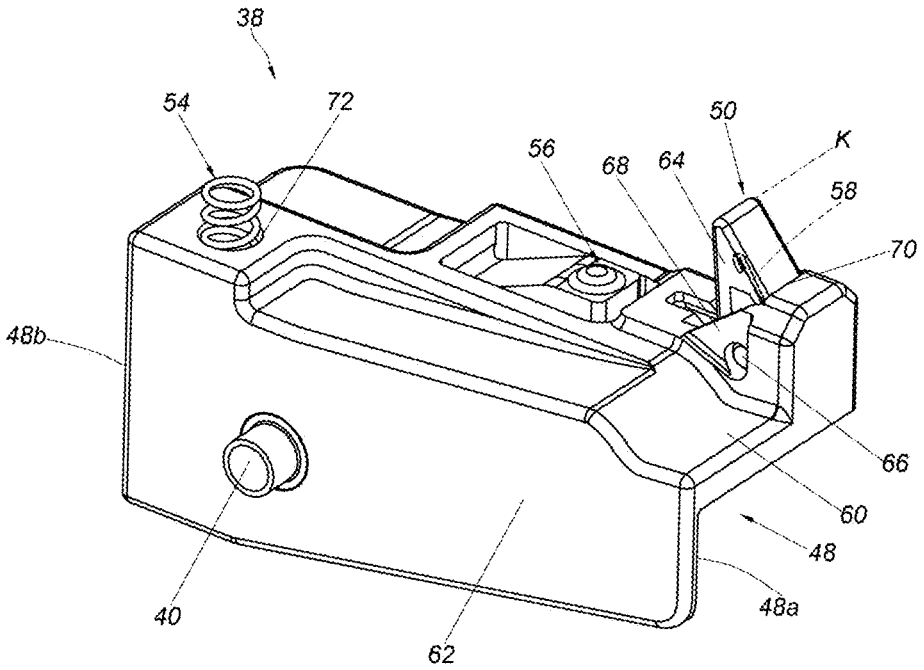
FIG. 4 and FIG. 5 are diagrams of a compensating device at different views according to the embodiment of the present invention.
Figure 5:
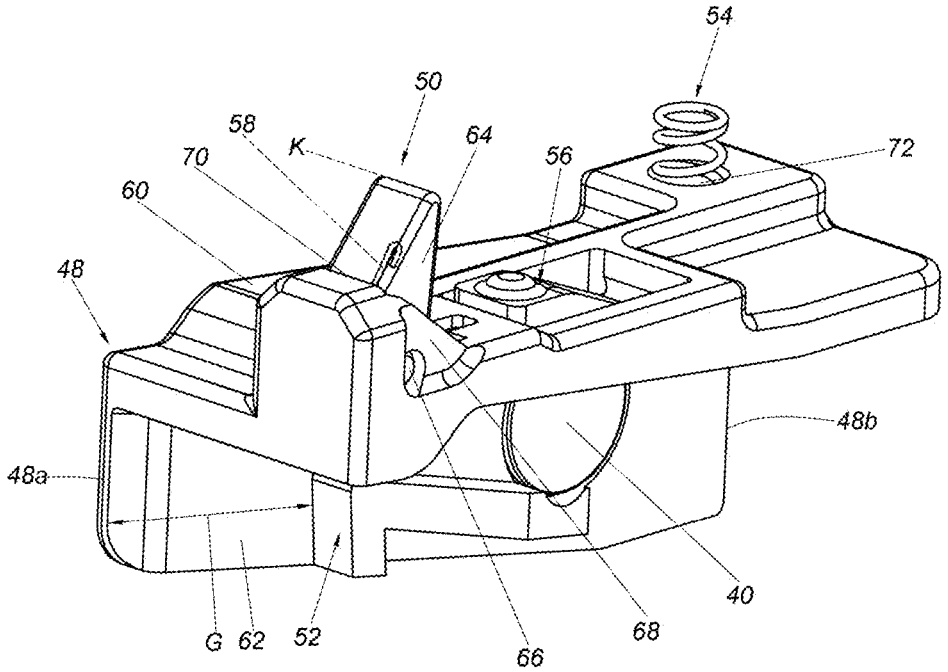

As shown in FIG. 4 and FIG. 5, the compensating device 38 includes a main body 48, a working member 50, a predetermined feature 52, a resilient member 54 and a resilient portion 56. Preferably, the compensating device 38 further includes a recovering resilient member 58.

The main body 48 includes a first main body portion 60 and a second main body portion 62 connected to the first main body portion 60. In this embodiment, by way of example, the second main body portion 62 is connected to the first main body portion 60 in a substantially perpendicular manner. However, the present invention is not limited to this embodiment. The shaft member 40 passes through the second main body portion 62 along the lateral direction or the transverse direction for achieving a pivotal connection of the compensating device 38 and the second rail 24.

The working member 50 is movably mounted on the main body 48. A second feature 64 is arranged on the working member 50 and configured to cooperate with the first feature 36. Preferably, the working member 50 is pivotally connected to a predetermined part 68 of the first main body portion 60 by a connecting member 66. Preferably, the working member 50 has a first end and a second end located opposite to the first end. For example, the first end and the second end of the working member 50 are a front end and a rear end of the working member 50, respectively. Preferably, the first main body portion 60 includes a blocking wall 70 located adjacent to the first end of the working member 50 for stopping the working member 50 at a working position K, and an avoiding space adjacent to the second end of the working member 50 for allowing the working member 50 to move away from the working position K.

As shown in FIG. 5, the predetermined feature 52 is arranged on the main body 48. The predetermined feature 52 can be arranged on the second main body portion 62 of the main body 48 directly or indirectly. In this embodiment, by way of example, the predetermined feature 52 can be a protrusion. However, the present invention is not limited to this embodiment. Preferably, the main body 48 has a first end 48*a* and a second end 48*b* located opposite to the first end 48*a*. For example, the first end 48*a* and the second end 48*b* of the main body 48 are a front end and a rear end of the main body 48, respectively. Preferably, the predetermined feature 52 is spaced away from the first end 48*a* of the main body 48 by a distance G.

The resilient member 54 is configured to provide a resilient force to the compensating device 38. In this embodiment, by way of example, a portion of the resilient member 54 is mounted inside a receiving space 72 of the first main body portion 60, and another portion of the resilient member 54 stretches out of the receiving space 72.

The resilient portion 56 is arranged on the main body 48. In this embodiment, by way of example, the resilient portion 56 is an extending arm. However, the present invention is not limited to this embodiment.

The recovering resilient member 58 is configured to provide a recovering resilient force to the working member 50, so as to drive the working member 50 to move toward the working position K.

Figure 6:
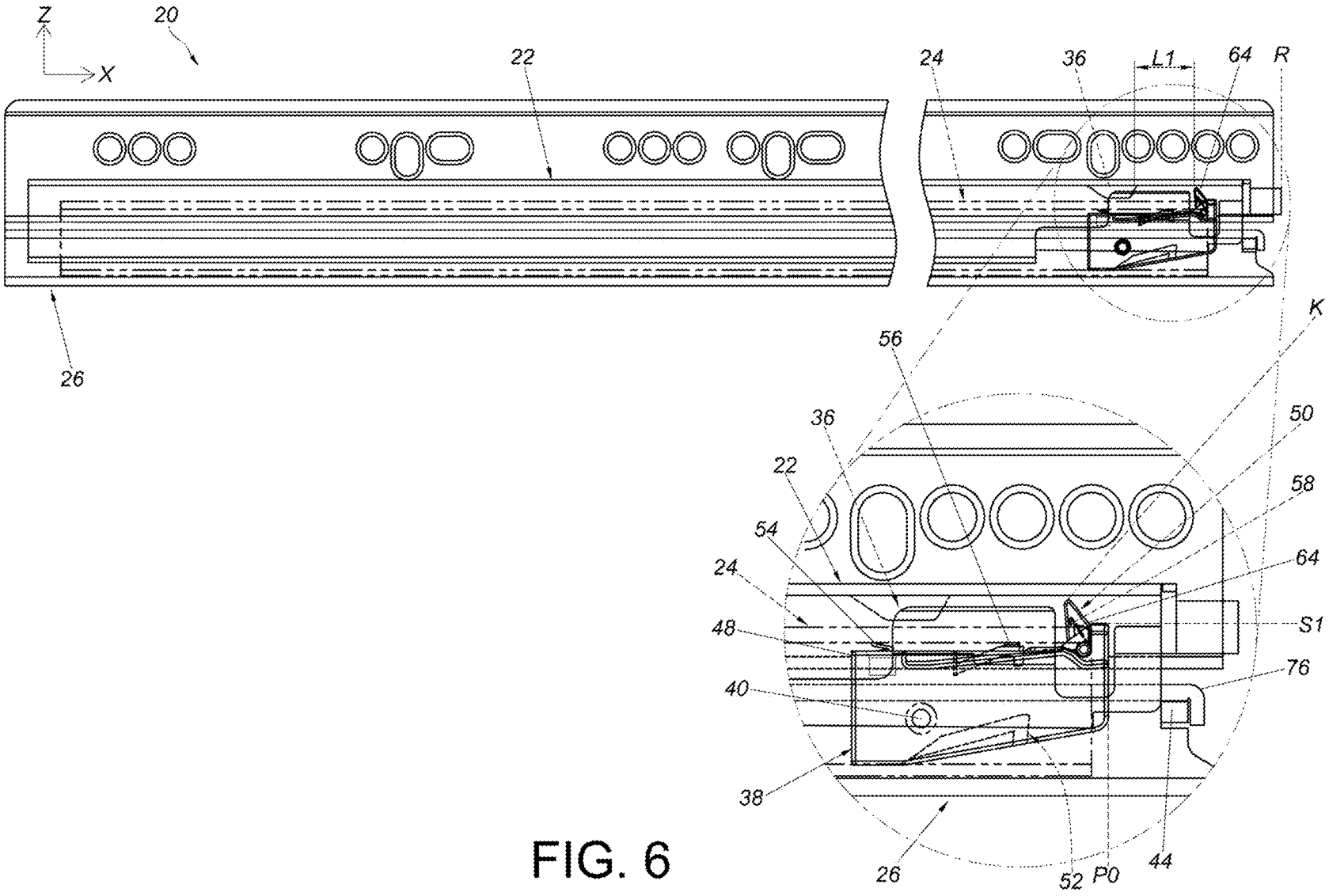
FIG. 6 is a diagram of the slide rail assembly in a first retracted state as a second rail is located at a predetermined position relative to a first rail according to the embodiment of the present invention.

When the slide rail assembly 20 is in a retracted state as shown in FIG. 6, the compensating device 38 is in a first state S1 in response to the resilient force provided by the resilient member 54, and the working member 50 is retained at the working position K in response to the recovering resilient force provided by the recovering resilient member 58. Besides, as shown in FIG. 6, at this moment, the second feature 64 is spaced away from the first feature 36 by a first longitudinal distance L1, and the predetermined feature 52 is located at a position corresponding to the blocking portion 44 of the third rail 26, e.g., the predetermined feature 52 and the blocking portion 44 of the third rail 26 are aligned with each other along the longitudinal direction. Preferably, as shown in FIG. 6, at this moment, the resilient member 54 is abutted between the main body 48 and the second rail 24, and the resilient portion 56 is located adjacent to the second rail 24. However, the present invention is not limited to this embodiment.

Furthermore, when the slide rail assembly 20 is in the retracted state as shown in FIG. 6, the first rail 22 is located at a retracted position R relative to the third rail 26. Ideally, when the first rail 22 is displaced to the retracted position R, the second rail 24 is configured to be displaced to a predetermined position P0 in response to a movement of the first rail 22 to the retracted position R. However, after a long-term usage, the second rail 24 might be located a position deviated from the predetermined position P0 due to repeated opening movements and retracting movements of the first rail 22 and the second rail 24 relative to the third rail 26, an operational mistake, and/or an unexpected external force.

Figure 7:
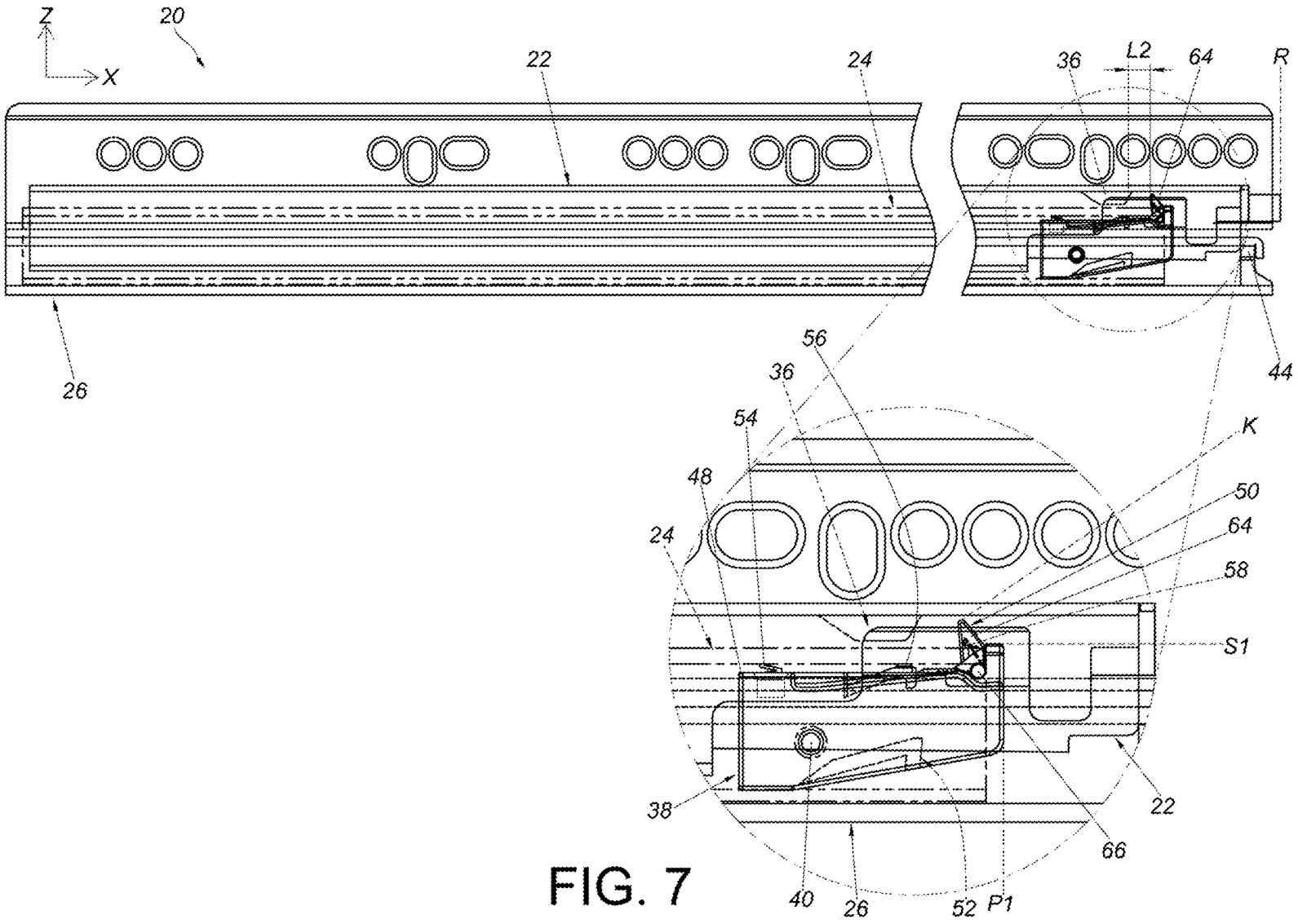
FIG. 7 is a diagram of the slide rail assembly in a second retracted state as the second rail is located at a lagging position relative to the first rail according to the embodiment of the present invention.

As shown in FIG. 7, when the second rail 24 is located at a lagging position P1 deviated from the predetermined position P0 relative to the first rail 22, the second feature 64 is spaced away from the first feature 36 by a second longitudinal distance L2 less than the first longitudinal distance L1.

Figure 8:
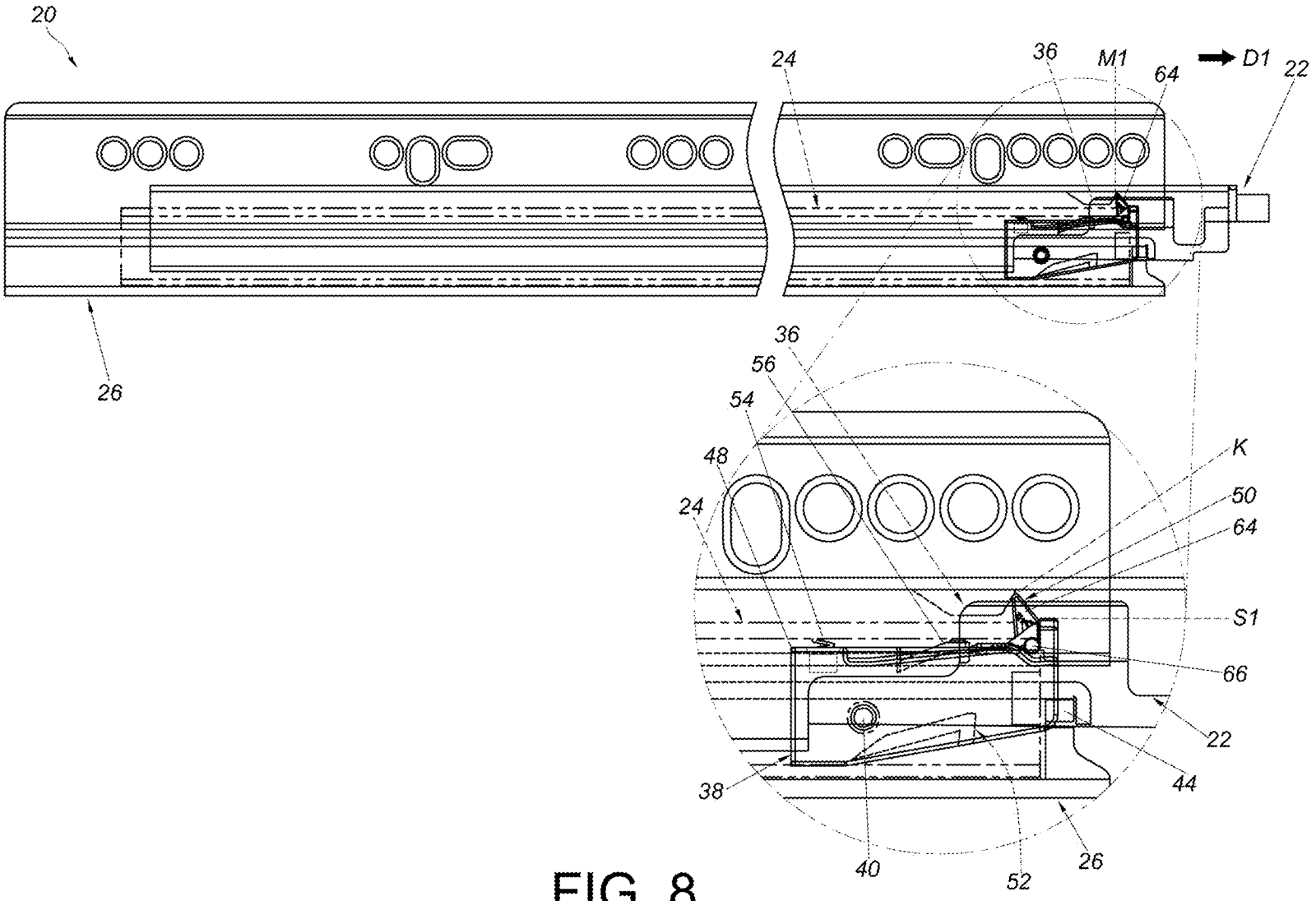
FIG. 8 is a diagram illustrating the first rail is displaced along the first direction from a position as shown in FIG. 7 to drive a first feature to abut against a second feature of the compensating device according to the embodiment of the present invention.
Figure 9:
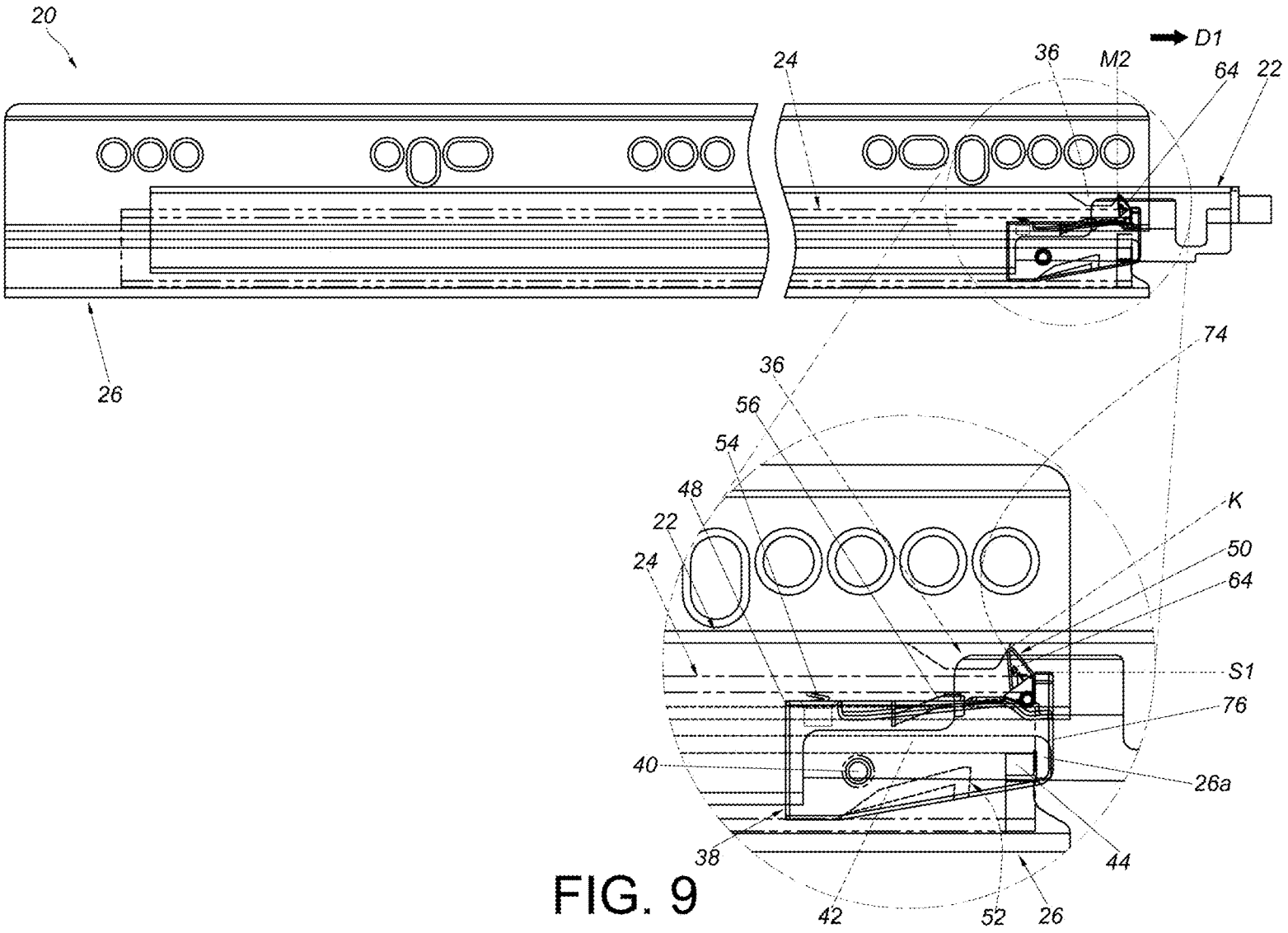
FIG. 9 is a diagram illustrating the first rail is displaced along the first direction from a position as shown in FIG. 8 to drive the second rail to displace from a first position to a second position along the first direction according to the embodiment of the present invention.
Figure 10:
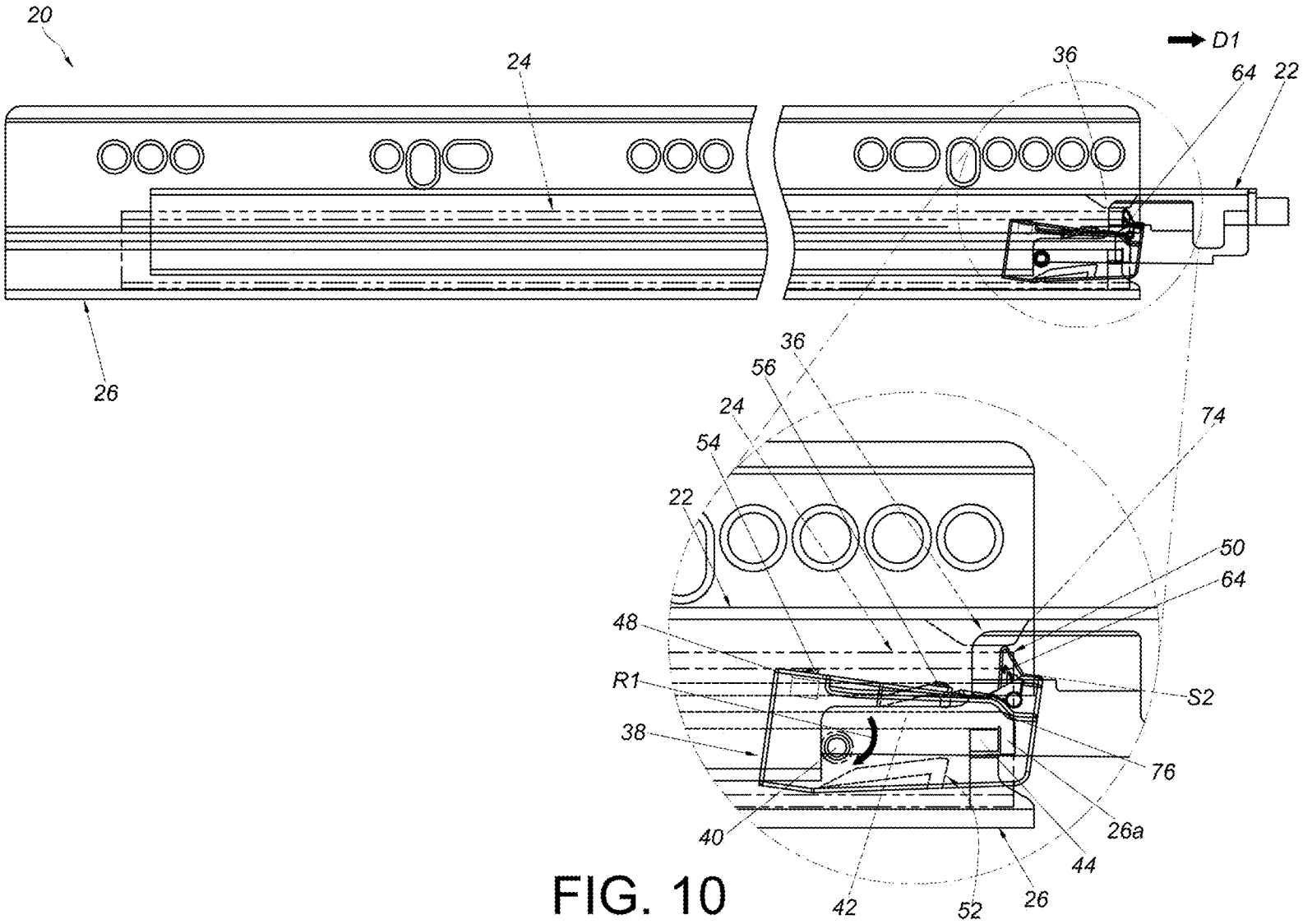
FIG. 10 is a diagram illustrating the first rail is displaced along the first direction from a position as shown in FIG. 9 to drive the compensating device to move from a first state to a second state according to the embodiment of the present invention.

As shown in FIG. 7 to FIG. 10, after the second rail 24 is displaced to the lagging position P1, the first rail 22 displacing along a first direction, e.g., an opening direction D1, from the retracted position R drives the first feature 36 and the second feature 64 of the compensating device 38 in the first state S1 to abut against each other to drive the second rail 24 to synchronously displace together with the first rail 22 along the opening direction D1 for a first predetermined distance, e.g., from a first position M1 to a second position M2, so as to compensate a lagging position error, i.e., a deviation between the lagging position P1 and the predetermined position P0, until the compensating device 38 is driven to pivot relative to the third rail 26 from the first state S1 to a second state S2 along a first pivoting direction R1 by the shaft member 40. In other words, when the compensating device 38 is in the second state S2, a synchronous displacement relation of the second rail 24 and the first rail 22 is terminated for allowing a further displacement of the first rail 22 along the opening direction D1 without any obstruction because the first feature 36 does not abut with the second feature 64 of the compensating device 38 in the second state S2. Besides, as shown in FIG. 10, when the compensating device 38 is in the second state S2, the resilient member 54 is resiliently deformed, and the resilient portion 56 is moved away from the second rail 24. In addition, as shown in FIG. 10, when the compensating device 38 is in the second state S2, the predetermined feature 52 of the compensating device 38 is moved away from the position corresponding to the blocking portion 44 of the third rail 26, e.g., the predetermined feature 52 of the compensating device 38 is misaligned with the blocking portion 44 of the third rail 26 along the longitudinal direction. In other words, when the compensating device 38 is in the second state S2, a blocking relation of the blocking portion 44 of the third rail 26 and the predetermined feature 52 of the compensating device 38 is prevented for allowing a further displacement of the second rail 24 along the opening direction D1 without any obstruction because the predetermined feature 52 of the compensating device 38 is misaligned with the blocking portion 44 of the third rail 26 along the longitudinal direction.

Preferably, one of the first feature 36 and the second feature 64 includes a first guiding portion 74. For example, the first guiding portion 74 can be an inclined surface or an arc surface. In this embodiment, by way of example, the first feature 36 includes the first guiding portion 74. However, the present invention is not limited to this embodiment. When the second rail 24 is synchronously displaced together with the first rail 22 along the opening direction D1 relative to the third rail 26 from the first position M1 as shown in FIG. 8 to the second position M2 as shown in FIG. 9, the compensating device 38 is displaced along the supporting section 42 of the third rail 26 to exceed the first end portion 26*a* of the third rail 26. After the compensating device 38 exceeds the first end portion 26*a* of the third rail 26, the compensating device 38 is free to be driven to move from the first state S1 as shown in FIG. 9 to the second state S2 as shown in FIG. 10 along the first pivoting direction R1 by an abutment of the first guiding portion 74 and the second feature 64.

Preferably, a guiding section 76 is formed on a connection of the supporting section 42 and the first end portion 26*a* of the third rail 26 for facilitating the compensating device 38 to move from the first state S1 to the second state S2 relative to the third rail 26. For example, the guiding section 76 can be a chamfer edge.

Figure 11:
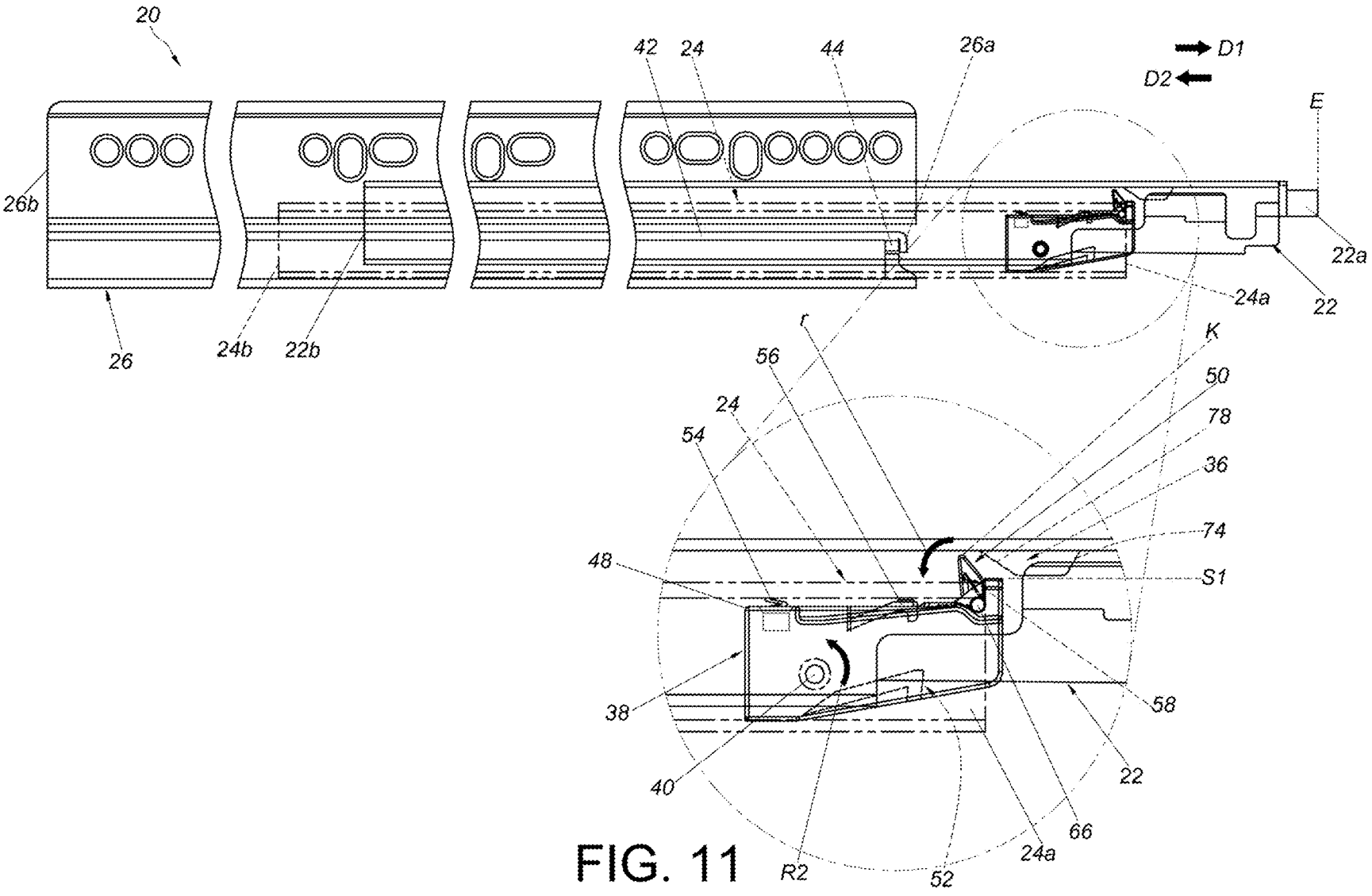
FIG. 11 is a diagram of the slide rail assembly in an extended state according to the embodiment of the present invention.

As shown in FIG. 11, after the synchronous displacement relation of the second rail 24 and the first rail 22 is terminated and the blocking relation of the blocking portion 44 of the third rail 26 and the predetermined feature 52 of the compensating device 38 is prevented, the first rail 22 and the second rail 24 can be displaced relative to the third rail 26 along the opening direction D1 individually, so as to switch the slide rail assembly 20 to an extended state as shown in FIG. 11 by locating the first rail 22 at an extended position E, e.g., a fully extended position. When the slide rail assembly 20 is in the extended state, i.e., the first rail 22 is located at the extended position E, the first end portion 22*a* of the first rail 22 and the first end portion 24*a* of the second rail 24 exceed the first end portion 24*a* of the second rail 24 and the first end portion 26*a* of the third rail 26, respectively.

Preferably, when the slide rail assembly 20 moves from a state as shown in FIG. 10 to the extended state as shown in FIG. 11, the compensating device 38 moves from the second state S2 as shown in FIG. 10 to the first state S1 as shown in FIG. 11 along a second pivoting direction R2 opposite to the first pivoting direction R1 in response to the resilient force provided by the resilient member 54. When the compensating device 38 moves from the second state S2 to the first state S1, the resilient portion 56 is configured to abut against the second rail 24 for providing a noise-reducing effect and/or an impact-buffering effect.

It should be noticed that after compensation of the deviation between the lagging position P1 and the predetermined position P0 is achieved, the second rail 24 can be driven to displace back to the predetermined position P0 as shown in FIG. 6 rather than the lagging position P1 in response to a displacement of the first rail 22 from the extended position E to the retracted position R along a second direction, e.g., a retracting direction D2.

Figure 12:
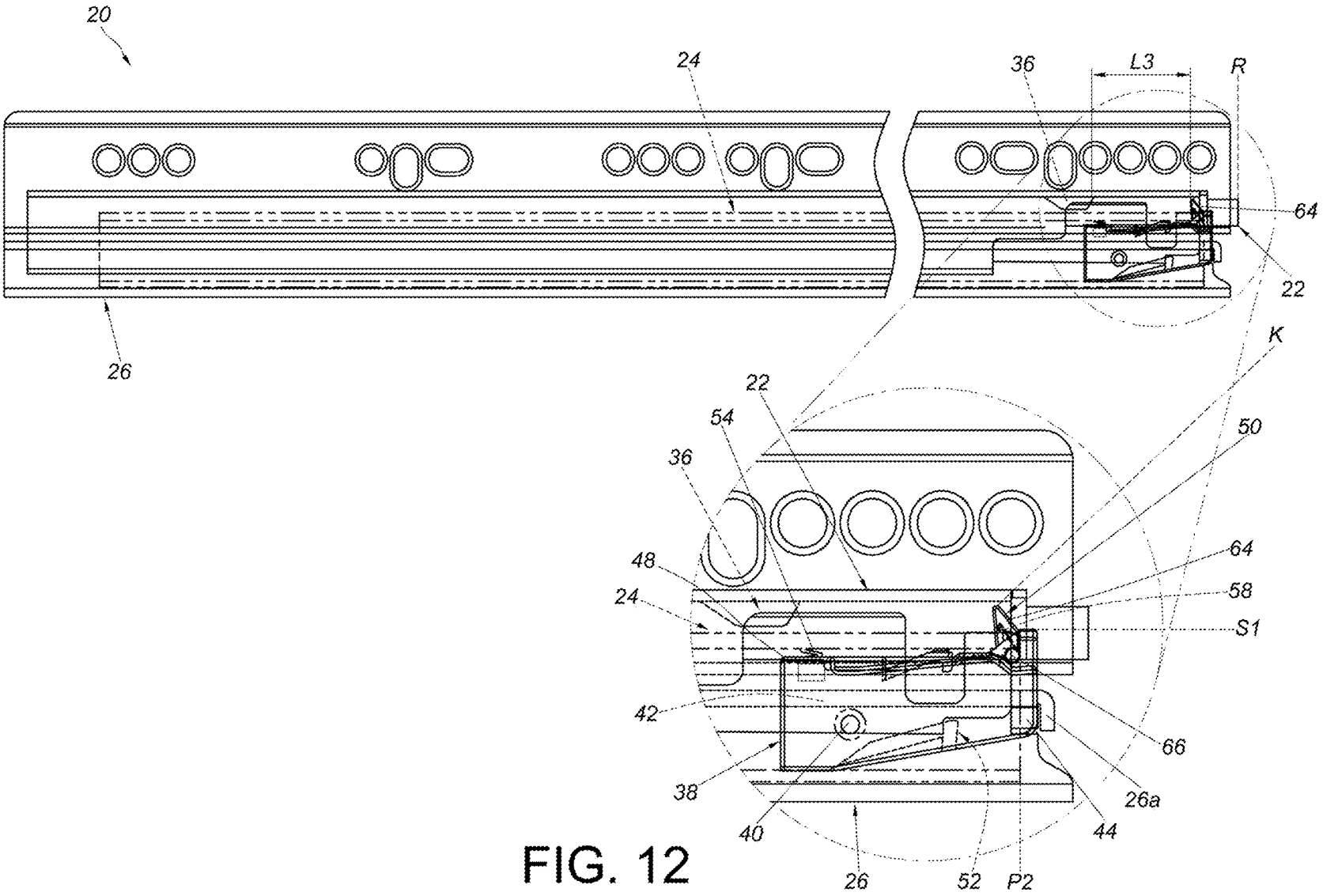
FIG. 12 is a diagram of the slide rail assembly a third retracted state as the second rail is located at an advancing position relative to the first rail according to the embodiment of the present invention.

As shown in FIG. 12, when the second rail 24 is located at an advancing position P2 deviated from the predetermined position P0 relative to the first rail 22, the second feature 64 is spaced away from the first feature 36 by a third longitudinal distance L3 greater than the first longitudinal distance L1.

Figure 13:
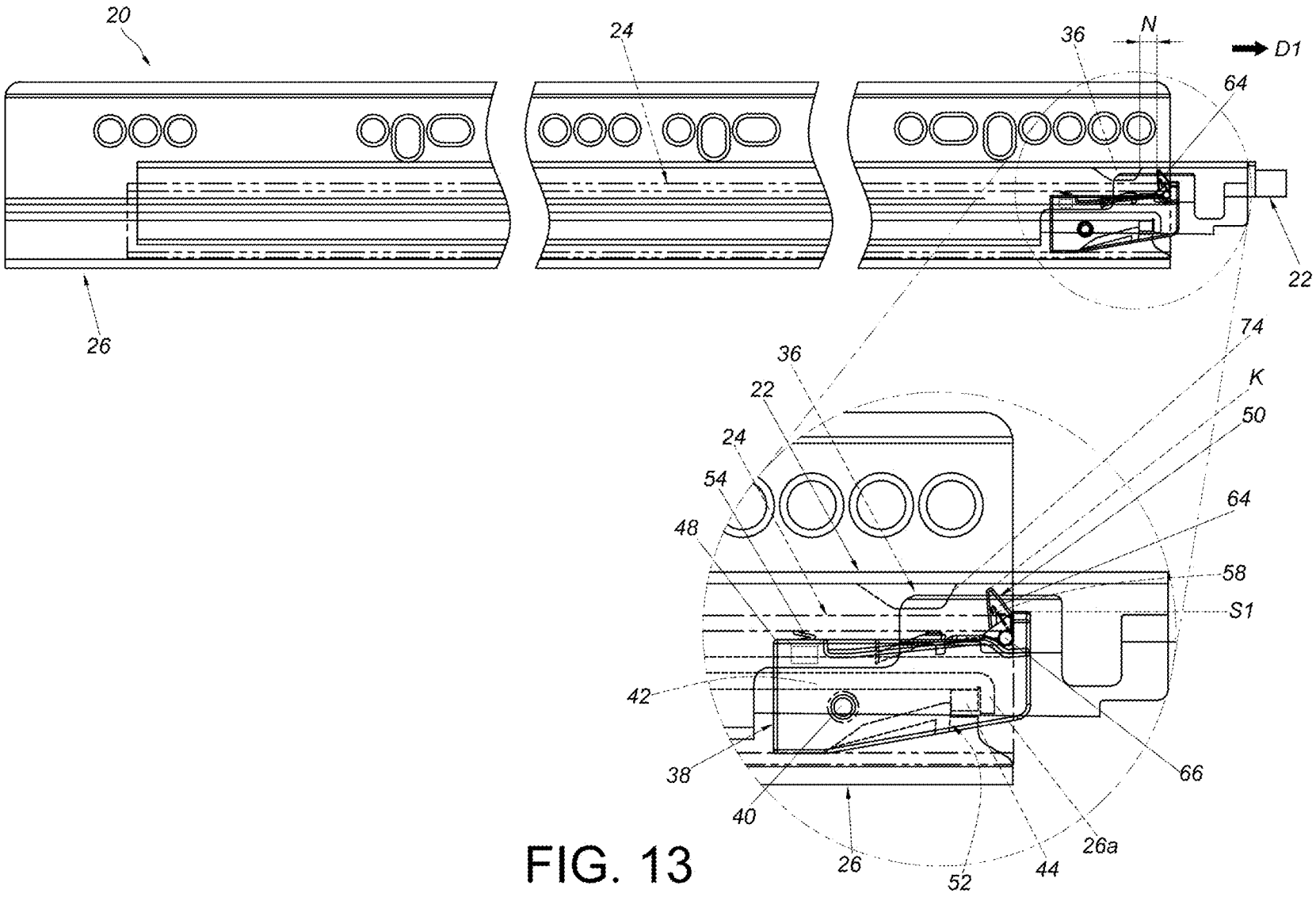
FIG. 13 is a diagram illustrating the first rail is displaced along the first direction from a position as shown in FIG. 12 to drive the blocking portion and the compensating device to block each other for stopping the second rail according to the embodiment of the present invention.
Figure 14:
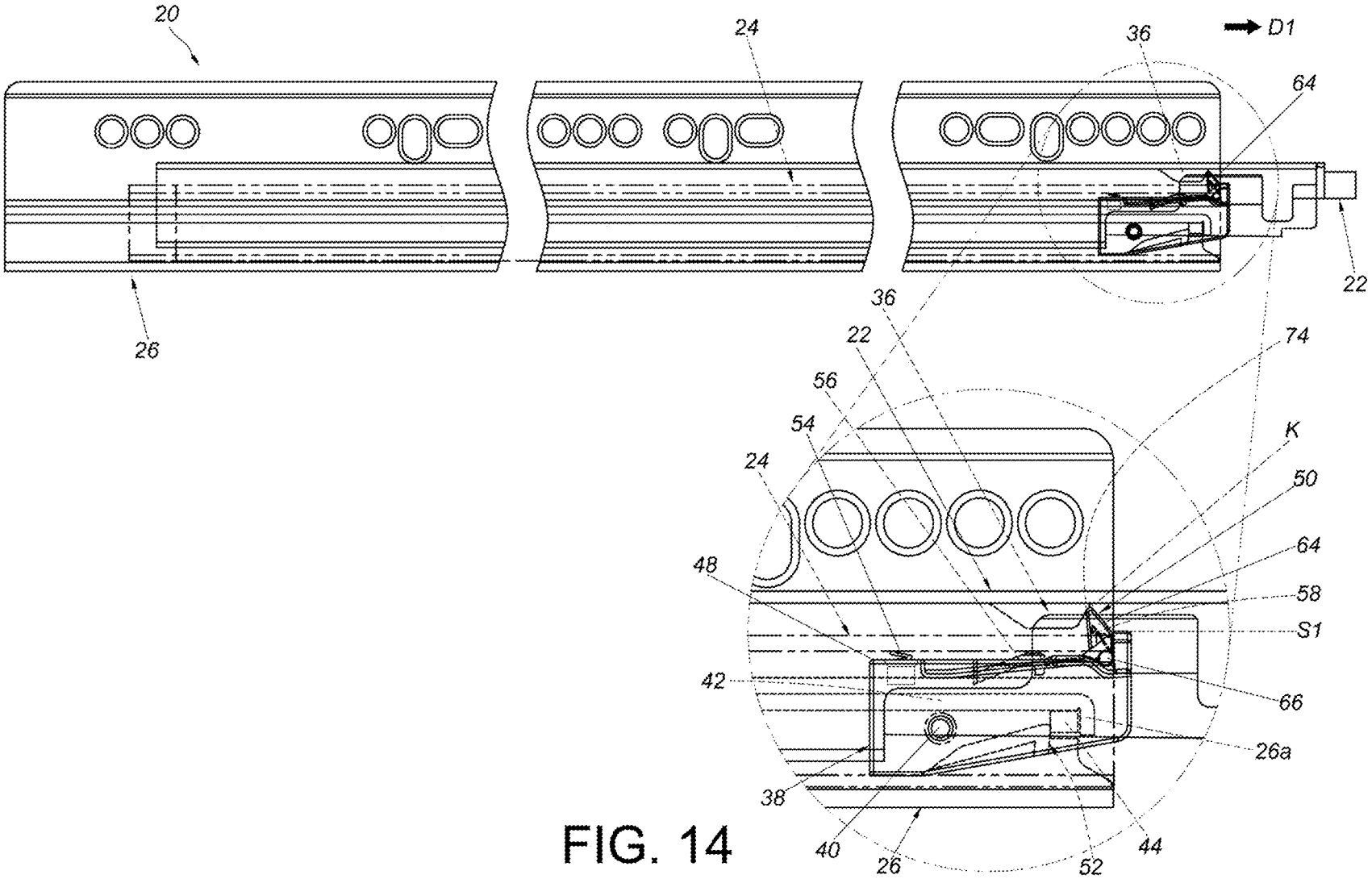
FIG. 14 is a diagram illustrating the first rail is displaced along the first direction from a position as shown in FIG. 13 to drive the first feature to abut against the second feature of the compensating device according to the embodiment of the present invention.

As shown in FIG. 12 to FIG. 15, after the second rail 24 is displaced to the advancing position P2, the first rail 22 displacing along the opening direction D1 from the retracted position R drives the blocking portion 44 of the third rail 26 and the predetermined feature 52 of the compensating device 38 in the first state S1 to block each other to stop the second rail 24, so as to compensate an advancing position error, i.e., a deviation between the advancing position P2 and the predetermined position P0, until the first rail 22 is displaced along the opening direction D1 over a second predetermined distance, e.g., a distance N from a position as shown in FIG. 13 to a position as shown in FIG. 14, to drive the first feature 36 and the second feature 64 of the compensating device 38 in the first state S1 to abut against each other to drive the compensating device 38 to pivot from the first state S1 to the second state S2 along the first pivoting direction R1 by the shaft member 40. In other words, when the compensating device 38 is in the second state S2, the blocking portion 44 of the third rail 26 does not block the predetermined feature 52 of the compensating device 38.

Figure 15:
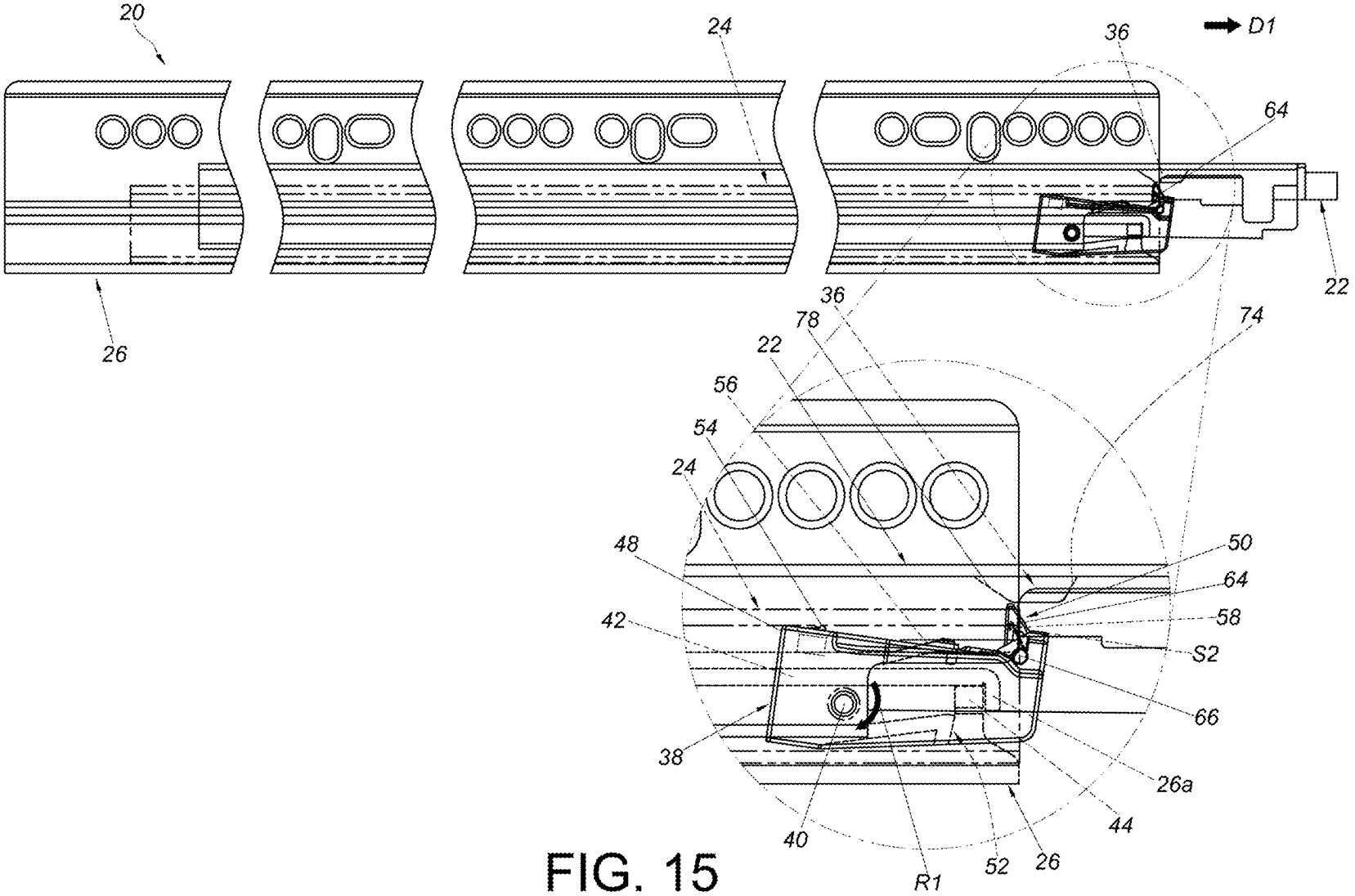
FIG. 15 is a diagram illustrating the first rail is displaced along the first direction from a position as shown in FIG. 14 to drive the compensating device to move from the first state to the second state for terminating a blocking relation of the blocking portion and the compensating device according to the embodiment of the present invention.

As shown in FIG. 15, when the compensating device 38 is in the second state S2, the first feature 36 is not blocked by the second feature 64 of the compensating device 38 for allowing a further displacement of the first rail 22 along the opening direction D1. In addition, as shown in FIG. 15, when the compensating device 38 is in the second state S2, the predetermined feature 52 of the compensating device 38 is moved away from the position corresponding to the blocking portion 44 of the third rail 26, e.g., the predetermined feature 52 of the compensating device 38 is misaligned with the blocking portion 44 of the third rail 26 along the longitudinal direction, such that the blocking relation of the blocking portion 44 of the third rail 26 and the predetermined feature 52 of the compensating device 38 is terminated, for allowing a further displacement of the second rail 24 along the opening direction D1. Furthermore, as shown in FIG. 15, when the compensating device 38 is in the second state S2, the resilient member 54 is resiliently deformed, and the resilient portion 56 is moved away from the second rail 24.

Preferably, as shown in FIG. 14, when the blocking portion 44 of the third rail 26 blocks the predetermined feature 52 of the compensating device 38, the compensating device 38 exceeds the first end portion 26*a* of the third rail 26, such that the compensating device 38 can be driven to move from the first state S1 as shown in FIG. 14 to the second state S2 as shown in FIG. 15 along the first pivoting direction R1 by an abutment of the first guiding portion 74 and the second feature 64.

Besides, as shown in FIG. 15, after the blocking relation of the blocking portion 44 of the third rail 26 and the predetermined feature 52 of the compensating device 38 is terminated, the first rail 22 and the second rail 24 can be displaced relative to the third rail 26 along the opening direction D1 individually to switch the slide rail assembly 20 in the extended state as shown in FIG. 11 by locating the first rail 22 at the extended position E.

Preferably, when the slide rail assembly 20 moves from a state as shown in FIG. 15 to the extended state as shown in FIG. 11, the compensating device 38 moves from the second state S2 as shown in FIG. 15 to the first state S1 as shown in FIG. 11 along the second pivoting direction R2 in response to the resilient force provided by the resilient member 54. When the compensating device 38 moves from the second state S2 to the first state S1, the resilient portion 56 is configured to abut against the second rail 24 for providing a noise-reducing effect and/or an impact-buffering effect.

It should be noticed that after compensation of the deviation between the advancing position P2 and the predetermined position P0 is achieved, the second rail 24 can be driven to displace back to the predetermined position P0 as shown in FIG. 6 rather than the advancing position P2 in response to the displacement of the first rail 22 from the extended position E to the retracted position R along the retracting direction D2.

Preferably, one of the first feature 36 and the second feature 64 includes a second guiding portion 78. For example, the second guiding portion 78 can be an inclined surface or an arc surface. In this embodiment, by way of example, the first feature 36 includes the second guiding portion 78, and the second guiding portion 78 is located opposite to the first guiding portion 74. Preferably, the first guiding portion 74 and the second guiding portion 78 are located adjacent to a front side and a rear side of the first feature 36. However, the present invention is not limited to this embodiment. When the first rail 22 is displaced from the extended position E to the retraced position R, the second guiding portion 78 is configured to abut against the working member 50 to drive the working member 50 to pivot away from the working position K along a predetermined pivoting direction r, so as to allow the first feature 36 to pass over the working member 50 along the retracting direction D2. After the first feature 36 passes over the working member 50 along the retracting direction D2, the working member 50 can pivot back to the working position K in response to the recovering resilient force provided by the recovering resilient member 58.

Figure 16:
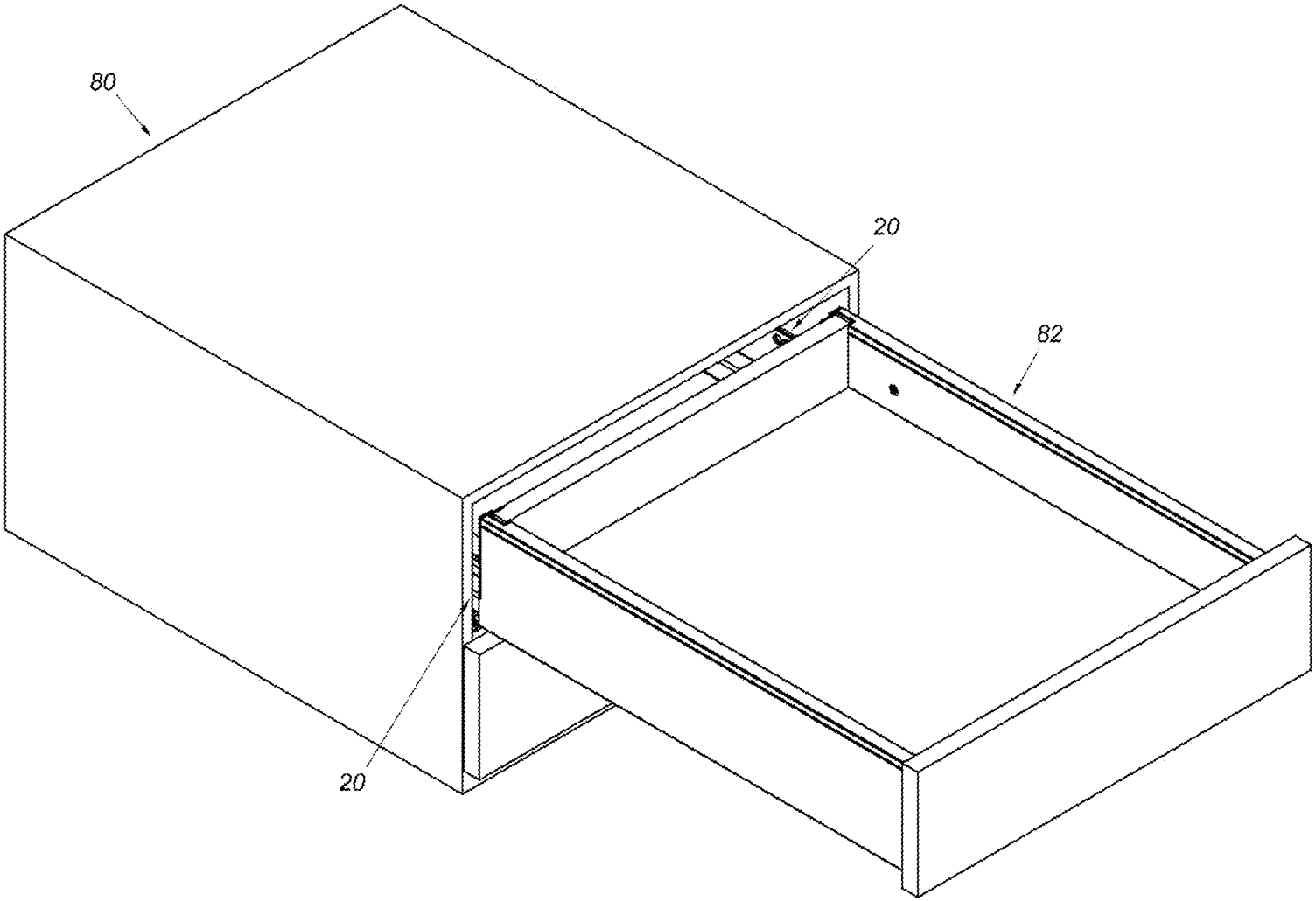
FIG. 16 is a diagram of the slide rail assembly adapted for a furniture according to the embodiment of the present invention.

As shown in FIG. 11 and FIG. 16, the slide rail assembly 20 can be adapted for a furniture. For example, there can be two slide rail assemblies 20 mounted between a drawer 82 and a cabinet body 80 symmetrically for facilitating a movement of the drawer 82 relative to the cabinet body 80. Specifically, the third rail 26 of each of the two slide rail assemblies 20 is configured to be mounted on the cabinet body 80, and the first rail 22 of each of the two slide rail assemblies 20 is configured to be support the drawer 82.

In conclusion, the slide rail assembly 20 includes the following characteristics.

1. The slide rail assembly 20 is capable of compensating an error of a relative position of at least two slide rails, e.g., the first rail 22 and the second rail 24, by utilizing the compensating device 38.
2. No matter whether the second rail 24 is located at the lagging position P1, the advancing position P2 or the predetermined position P0, the first rail 22 displacing along the opening direction D1 from the retracted position R drives the first feature 36 and the second feature 64 of the compensating device 38 in the first state S1 to abut against each other until the compensating device 38 is driven to move from the first state S1 to the second state S2.
3. When the compensating device 38 moves from the second state S2 to the first state S1, the resilient portion 56 is configured to abut against the second rail 24 for providing a noise-reducing effect and/or an impact-buffering effect.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A slide rail assembly comprising:

a first rail;

a second rail;

a first aid-sliding device comprising at least one first rotating member configured to be rotatably supported between the first rail and the second rail;

a first feature arranged on the first rail;

a compensating device mounted on the second rail and movable between a first state and a second state, the compensating device being pivotally connected to the second rail, and the compensating device comprising a second feature and a predetermined feature; and a third rail, the second rail being movably mounted on the third rail, the third rail comprising a supporting section and a blocking portion, and the supporting section being configured to support the compensating device;

wherein after the second rail is displaced to a lagging position relative to the first rail, the first rail displacing along an opening direction drives the first feature and the compensating device in the first state to abut against each other to drive the second rail to synchronously displace together with the first rail along the opening direction for a first predetermined distance until the compensating device is driven to move from the first state to the second state;

wherein after the second rail is displaced to an advancing position relative to the first rail, the first rail displacing along the opening direction drives the compensating device in the first state to displace along the opening direction to cause the blocking portion of the third rail and the compensating device in the first state to block each other to prevent a displacement of the second rail relative to the third rail along the opening direction to stop the second rail until the first rail is displaced along the opening direction over a second predetermined distance to drive the first feature and the compensating device in the first state to abut against each other to drive the compensating device to move from the first state to the second state, and when the compensating device is in the second state, the blocking portion of the third rail does not block the compensating device;

wherein after the second rail is displaced to the lagging position relative to the first rail, the first rail displacing along the opening direction drives the first feature and the second feature of the compensating device in the first state to abut against each other, so as to drive the second rail to synchronously displace together with the first rail along the opening direction for the first predetermined distance;

wherein one of the first feature and the second feature comprises a first guiding portion, after the second rail is displaced to the advancing position relative to the first rail, the first rail displacing along the opening direction drives the blocking portion of the third rail and the predetermined feature of the compensating device in the first state to block each other to stop the second rail until the first rail is displaced along the opening direction over the second predetermined distance to drive the first feature and the second feature of the compensating device in the first state to abut against each other by the first guiding portion, so as to drive the compensating device to move from the first state to the second state, and when the compensating device is in the second state, the blocking portion of the third rail does not block the predetermined feature of the compensating device.

2. The slide rail assembly of claim 1, further comprising a second aid-sliding device comprising at least one second rotating member rotatably supported between the second rail and the third rail.

3. The slide rail assembly of claim 1, wherein the compensating device further comprises a main body and a working member, the working member is movably mounted on the main body, and the second feature is arranged on the working member.

4. The slide rail assembly of claim 3, wherein the compensating device further comprises a recovering resilient member, the one or another one of the first feature and the second feature further comprises a second guiding portion, during a displacement of the first rail along a retracting direction, the first feature and the second feature of the compensating device in the first state abut against each other by the second guiding portion to drive the working member to move away from a working position for allowing the first feature to pass over the working member along the retracting direction, and after the first feature passes over the working member, the working member moves to the working position in response to a recovering resilient force provided by the recovering resilient member.

5. The slide rail assembly of claim 3, wherein the working member is pivotally connected to the main body.

6. The slide rail assembly of claim 1, wherein the compensating device further comprises a resilient member, and the compensating device moves from the second state to the first state in response to a resilient force provided by the resilient member.

7. The slide rail assembly of claim 6, wherein the compensating device further comprises a resilient portion configured to abut against the second rail when the compensating device moves from the second state to the first state.

8. The slide rail assembly of claim 1, wherein the third rail is configured to be mounted on a cabinet body, and the first rail is configured to support a drawer.

9. A slide rail assembly comprising:

a first rail;

a second rail;

a third rail, the second rail being movably mounted between the third rail and the first rail, the third rail comprising a supporting section and a blocking portion, and the supporting section being configured to support the second rail;

a first feature arranged on the first rail; and a compensating device arranged on the second rail and movable between a first state and a second state, the compensating device being pivotally connected to the second rail, and the compensating device comprising a second feature and a predetermined feature;

wherein after the second rail is displaced to an advancing position deviated from a predetermined position relative to the first rail, the first rail displacing along a first direction drives the compensating device in the first state to displace along the first direction to cause the blocking portion of the third rail and the compensating device in the first state to block each other to prevent a displacement of the second rail relative to the third rail along the first direction to stop the second rail until the first feature and the compensating device in the first state abut against each other to drive the compensating device to move from the first state to the second state;

wherein when the compensating device is in the second state, the blocking portion of the third rail does not block the compensating device;

wherein after the second rail is displaced to a lagging position deviated from the predetermined position relative to the first rail, the first rail displacing along the first direction drives the first feature and the compensating device in the first state to abut against each other to drive the second rail to synchronously displace together with the first rail along the first direction until the compensating device is driven to move from the first state to the second state, and when the compensating device is in the second state, the first feature does not abut with the compensating device;

wherein in response to a displacement of the first rail from an extended position to a retracted position along a second direction opposite to the first direction, the second rail is displaced to the predetermined position relative to the first rail;

wherein after the second rail is displaced to the lagging position relative to the first rail, the first rail displacing along the first direction drives the first feature and the second feature of the compensating device in the first state to abut against each other, so as to drive the second rail to synchronously displace together with the first rail along the first direction for a first predetermined distance;

wherein one of the first feature and the second feature comprises a first guiding portion, after the second rail is displaced to the advancing position relative to the first rail, the first rail displacing along the first direction drives the blocking portion of the third rail and the predetermined feature of the compensating device in the first state to block each other to stop the second rail until the first rail is displaced along the first direction over a second predetermined distance to drive the first feature and the second feature of the compensating device in the first state to abut against each other by the first guiding portion, so as to drive the compensating device to move from the first state to the second state, and when the compensating device is in the second state, the blocking portion of the third rail does not block the predetermined feature of the compensating device.

10. The slide rail assembly of claim 9, further comprising a first aid-sliding device and a second aid-sliding device, the first aid-sliding device comprising at least one first rotating member rotatably supported between the first rail and the second rail, and the second aid-sliding device comprising at least one second rotating member rotatably supported between the second rail and the third rail.

11. The slide rail assembly of claim 9, wherein the compensating device further comprises a main body and a working member, the working member is movably mounted on the main body, and the second feature is arranged on the working member.

12. The slide rail assembly of claim 11, wherein the compensating device further comprises a recovering resilient member, one of the first feature and the second feature further comprises a second guiding portion, during a displacement of the first rail along the second direction, the first feature and the second feature of the compensating device in the first state abut against each other by the second guiding portion to drive the working member to move away from a working position for allowing the first feature to pass over the working member along the second direction, and after the first feature passes over the working member along the second direction, the working member moves to the working position in response to a recovering resilient force provided by the recovering resilient member.

13. The slide rail assembly of claim 9, wherein the compensating device further comprises a resilient member, and the compensating device moves from the second state to the first state in response to a resilient force provided by the resilient member.

14. The slide rail assembly of claim 13, wherein the compensating device further comprises a resilient portion configured to abut against the second rail when the compensating device moves from the second state to the first state.

* * * * *